US005797141A

United States Patent [19]

Morlett

[11] Patent Number: 5,797,141

[45] Date of Patent: Aug. 25, 1998

[54] FACE SHIELD/FAN

[76] Inventor: Oscar Louis Morlett, 22951 Lynda La., Lake Forest, Calif. 92630

[21] Appl. No.: 982,729

[22] Filed: Dec. 2, 1997

[51] Int. Cl.[6] ..... A41D 13/00

[52] U.S. Cl. ..... 2/9; 2/174

[58] Field of Search ..... 2/9, 174, 206, 2/11, 15; 132/212, 319; 128/857, 858

[56] References Cited

U.S. PATENT DOCUMENTS

| | | | |
|---|---|---|---|
| D. 210,183 | 2/1968 | Ross | 2/9 |
| 1,923,340 | 8/1933 | Steckler | 2/174 |
| 3,060,445 | 10/1962 | Brockman | 2/9 |
| 3,328,806 | 7/1967 | Allegro | 2/174 |
| 3,602,913 | 9/1971 | Neese | 2/9 |
| 3,963,034 | 6/1976 | Runberg et al. | 132/9 |
| 4,638,512 | 1/1987 | Frankel | 2/174 |
| 4,837,861 | 6/1989 | Cole | 2/9 |
| 4,945,574 | 8/1990 | Dagher | 2/206 |
| 5,440,760 | 8/1995 | Highsmith | 2/11 |
| 5,727,565 | 3/1998 | Wood | 2/9 |

*Primary Examiner*—Amy B. Vanatta
*Attorney, Agent, or Firm*—Stetina Brunda Garred & Brucker

[57] ABSTRACT

In accordance with the present invention, there is provided a face shield/fan for protecting a user's face against spray and against spillage occurring at the user's forehead, for dissipating odors and heat and for facilitating drying, the face shield/fan is provided with a mask. The mask is generally formed to receive a user's face and is provided with an upper portion and a lower portion. The upper portion is generally formed to correspond to the user's forehead. The face shield/fan is further provided with a sealing member which is attachable to the upper portion of the mask. The sealing member is generally formed to conform to the contours of the user's forehead for sealing therewith, for directing spillage occurring at the user's forehead away from the user's face. The face shield/fan is further provided with a handle. The handle is disposable adjacent to the lower portion of the mask and is used for manually supporting the face shield/fan against the user's forehead and for facilitating waving of the face shield/fan to dissipate odors and heat and facilitate drying.

20 Claims, 2 Drawing Sheets

Fig. 3
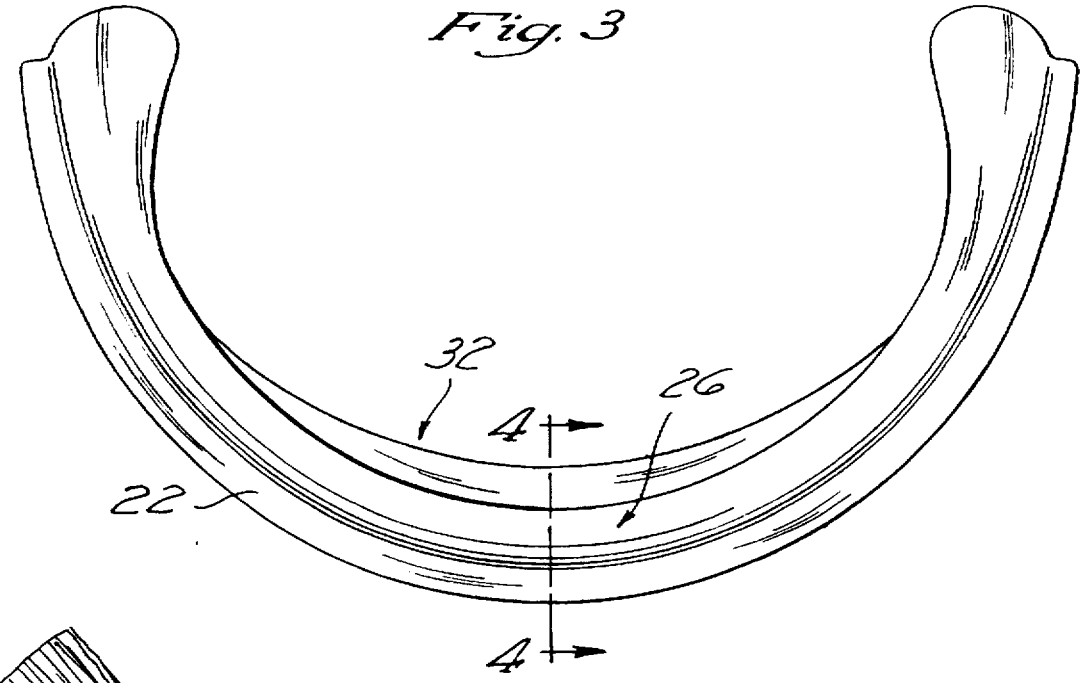
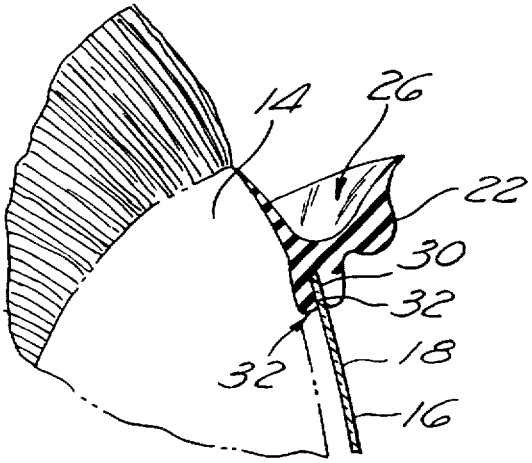
Fig. 4
Fig. 5
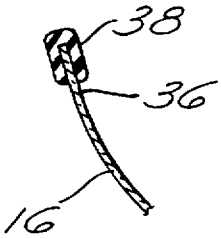

FACE SHIELD/FAN

FIELD OF THE INVENTION

The present invention relates generally to protective face shields, and more particularly to a face shield which protects the user's face against spray and against spillage occurring at the user's forehead and which may be utilized as a fan for dissipating odors and heat and for facilitating drying.

BACKGROUND OF THE INVENTION

There are a variety of face shields for protecting a user's face from undesirable contact with fluid sprays and spillage at the user's forehead. These shields have particular application in the hair styling/cosmetology and medical industries.

For example, in the hair styling industry hair spray is commonly used. And in the medical industry context, hair growth medication may be sprayed onto the scalp. Unless the face is protected from such sprays, inhalation of the spray, eye and skin irritation, and interference with the application of facial make-up may result.

In addition, face shields are used to protect the user's face from the fluid spillage at the user's forehead. For example, such spillage may simply be water applied to the hair or scalp. There are a variety of procedures which require saturating, irrigating and otherwise applying various fluids and solutions to the hair. Such procedures may include, but are not limited to, shampooing and hair styling procedures such as perms, dyeing, tinting, frosting, highlighting, hair curling and hair straightening. Face shields have particular application during these procedures where facial contact is to be avoided with spillage of the various fluids and solutions. In addition, such shields protect the user from fumes associated with chemicals in the various fluids and solutions.

In addition, face shields may have application during simple hair cutting procedures. During hair cutting, hair cuttings typically fall onto the face and a face shield would prevent such undesirable contact.

Various face shields have been developed in the art. For example in U.S. Pat. No. 4,856,535 to Forbes, there is provided a face shield which is provided with an adhesive strip at the uppermost portion of the shield for affixing the shield to the face. While such an arrangement may be effective in protecting the face against fluid sprays, there are several problems associated with such a design. The shield is not readily removable and reattachable to and from the user's face. Typically, a user would not desire to use a face shield when not required for protection. Such removability/reattachablity features of a face shield are especially desirable where the shield is intermittently required. In addition, there are problems with the nature of the adhesive seal. As the adhesive seal is increasingly exposed to fluids, the adhesive characteristic decreases which leads to leakage and attachment problems.

Other designs have been developed to affix the face shield to the user's face. For example, referring to U.S. Pat. No. 5,088,114 to Salce et al., there is provided a face shield which is provided with either arm members which clamp around the user's head or a strap to hold the device in contact with the user's head. Such clamping arm members and head straps tend to make the face shield not readily removable. In addition, clamping arm members and head straps may interfere with the particular procedure which the user is under going. For example, it would be difficult to shampoo a user's hair with a head strap in place.

Other prior art face shields have avoided the above methods of affixing the shields to the user's face by provided the face shield with a handle for manually holding the device adjacent to the user's face and for removing the face shield when facial protection is not needed. For examples, see U.S. Pat. No. 3,772,707 to Alosi et al. and German Patent No. 3,500,198 to Esse. A problem with these and other prior art face shields, however, is that they may not be equipped with a seal at the forehead (e.g., U.S. Pat. No. 3,772,707 to Alosi et al.). Even where a forehead seal may be included (e.g., the rubberized edge contemplated in German Patent No. 3,500, 198 to Esse), another problem encountered by prior art designs is that when fluids are encountered at the forehead the fluid may run down the front of the shield. This is especially problematic where the fluid is a dye and may result in obstructing viewing through the shield. In addition, when fluids run down the front of the shield, the fluids would continue to run down the handle and onto the user's hand and arm. This is especially undesirable where the fluids are dyes or other chemicals. No attempt has been made to direct the fluids away from the face, toward the sides.

Accordingly, there is a need in the art for a device which is readily removed from the user's face, protects the user's face against spray and against spillage occurring at the user's forehead, and directs spillage occurring at the user's forehead away from the face.

SUMMARY OF THE INVENTION

In accordance with the present invention, there is provided a face shield/fan for protecting a user's face against spray and against spillage occurring at the user's forehead, for dissipating odors and heat and for facilitating drying, the face shield/fan is provided with a mask. The mask is generally formed to receive a user's face and is provided with an upper portion and a lower portion. The upper portion is generally formed to correspond to the user's forehead. The face shield/fan is further provided with a sealing member which is attachable to the upper portion of the mask. The sealing member is generally formed to conform to the contours of the user's forehead for sealing therewith, for directing spillage occurring at the user's forehead away from the user's face. The face shield/fan is further provided with a handle. The handle is disposable adjacent to the lower portion of the mask and is used for manually supporting the face shield/fan against the user's forehead and for facilitating waving of the face shield/fan to dissipate odors and heat and facilitate drying.

In addition, the sealing member is provided with a channel. The channel is generally formed to span the width of the user's forehead and formed to face outward from the user's face, for directing spillage away from the user's face. In the preferred embodiment of the present invention, the channel is further formed to extend generally downward adjacent to the user's eyes, for directing spillage away from the user's face and eyes. The channel may also be formed to extend generally downward below the user's eyes, for increased protection of the face and eyes.

In the preferred embodiment of the present invention, the upper portion of the mask is provided with an upper edge and the sealing member is provided with a groove which is formed to receive the upper edge, for attaching the sealing member to the mask. The sealing member may comprise a generally flexible polymer material. Preferably, the sealing member comprises a rubber material. The mask may comprise a semi-rigid polymer material. Preferably, the mask comprises a thermoplastic material. In addition, the mask is formed of a transparent material for allowing the user to see therethrough and may contain indicia thereon and/or therein. The mask may be formed to generally resemble a particular set of ethnic facial features. The mask and the handle are formed of a continuous material.

The mask is preferably provided with a pair of opposed side edges and the face shield/fan is further provided with a pair of edge guards. The edge guards are formed to respectively receive the side edges and are formed of a generally flexible material, for protecting the user's face from the side edges of the mask.

In addition, there is provided a method of forming the above described face shield/fan of the present invention.

The face shield/fan of the present invention addresses the various problems associated with the prior art designs by providing a handle for manually holding the face shield/fan to the user's face and a sealing member for directing spillage occurring at the user's forehead away from the user's face.

The present invention mitigates that problems associated with designed which include an adhesive strip, arm members which clamp around the user's head or a head strap. As such, the face shield/fan is readily removable. In addition, the present invention does not substantially interfere with the particular procedure which the user is undergoing because clamping arm members, head straps or similar apparatus are not employed.

Advantageously, the present invention is equipped with a sealing member which directs fluids away from the face. This is especially the case where the sealing member is provided with a facially outward facing channel. Fluids from the user's forehead region which come into contact with the face shield/fan are directed away from the face, toward the sides of the face. As such, the problems associated with fluids running down the front of the shield are mitigated.

An additional attribute of the present invention is that it may be utilized as a fan, as facilitated by the handle and the general shape of the mask. Thus, the face shield/fan may be used for dissipating undesirable, fumes, odors and heat away from the face. In addition the face shield/fan may facilitate drying where drying is desirable at the face, forehead, scalp, hair, etc. Thus, the present invention serves a dual purpose which further enhances its novelty.

Accordingly, the face shield/fan of the present invention represents a substantial advance in the art.

BRIEF DESCRIPTION OF THE DRAWINGS

These, as well as other features of the present invention, will become more apparent upon reference to the drawings wherein:

FIG. 3 is top view of the sealing member;

FIG. 4 is a cross-sectional view of the sealing member shown in FIGS. 1 and 3, as seen along axis 4—4, as shown adjacent a user's forehead; and FIG. 5 is a cross-sectional view of an edge guard and a portion of the mask as shown in FIG. 5, as seen along axis 5—5.

DETAILED DESCRIPTION OF THE PREFERRED EMBODIMENT

Figure 1:
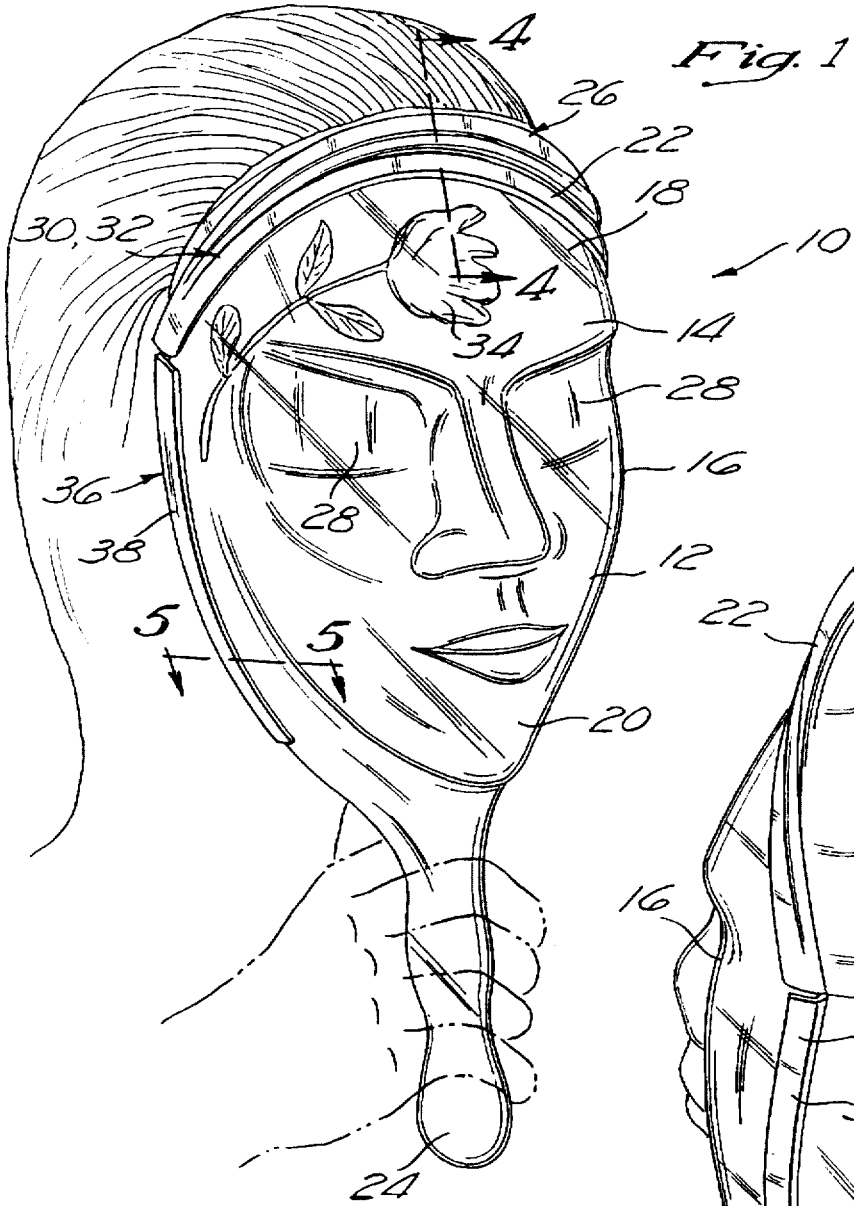
FIG. 1 is a perspective view of the face shield/fan constructed in accordance with the present invention as shown being held adjacent a user's face.

Referring now to the drawing wherein the showings are for purposes of illustrating of a preferred embodiment of the present invention only, and not for purposes of limiting the same, FIGS. 1–5 illustrate a face shield/fan 10 constructed in accordance with the present invention. As will be described in more detail below, the face shield/fan protects the user's face against spray and against spillage occurring at the user's forehead and may be utilized as a fan for dissipating odors and heat and for facilitating drying.

Referring now to FIGS. 1–5, in accordance with the present invention, there is provided a face shield/fan 10 for protecting a user's face 12 against spray and against spillage occurring at the user's forehead 14, for dissipating odors and heat and for facilitating drying, the face shield/fan 10 is provided with a mask 16. The mask 16 is generally formed to receive a user's face 12 and is provided with an upper portion 18 and a lower portion 20. The upper portion 18 is generally formed to correspond to the user's forehead 14. The face shield/fan 10 is further provided with a sealing member 22 which is attachable to the upper portion 18 of the mask 16. The sealing member 22 is generally formed to conform to the contours of the user's forehead 14 for sealing therewith, for directing spillage occurring at the user's forehead 14 away from the user's face 12. Thus, it is contemplated that the sealing member 22 seals against the user's forehead 14 to protect against fluid spillage occurring there at from running down onto the user's face 12. In addition, because of the configuration of the sealing member 22 fluid spillage is directed away from and toward to sides of the user's face 12. The face shield/fan 10 is further provided with a handle 24. The handle 24 is disposable adjacent to the lower portion 20 of the mask 16 and is used for manually supporting the face shield/fan 10 against the user's forehead 14 and for facilitating waving of the face shield/fan 10 to dissipate odors and heat and facilitate drying.

Figure 2:
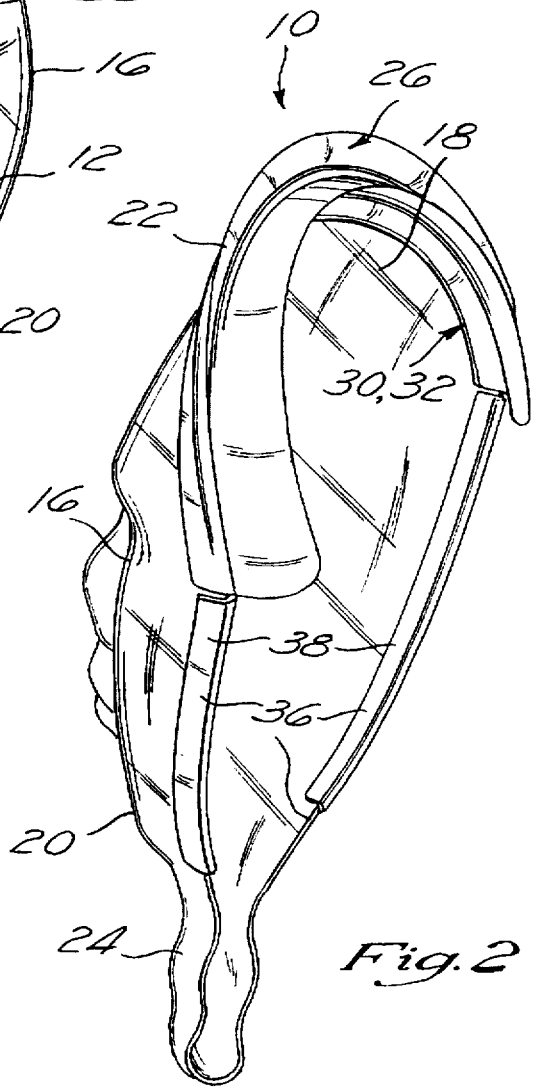
FIG. 2 is another perspective view of the face shield/fan of the present invention.

In addition, the sealing member 22 is provided with a channel 26. The channel 26 is generally formed to span the width of the user's forehead 14 and formed to face outward from the user's face 12, for directing spillage away from the user's face 12. It is contemplated that as fluid spillage occurring at the user's forehead 14 is encountered with the channel 26 of the sealing member 22, the spillage is directed laterally and away from the user's face 12. In the preferred embodiment of the present invention, the channel 26 is further formed to extend generally downward adjacent to the user's eyes 28, for directing spillage away from the user's face 12 and eyes 28, as best shown in FIGS. 2, 3 and 4. The channel 26 may also be formed to extend generally downward below the user's eyes 28, for increased protection of the face 12 and eyes 28. It is contemplated that the channel 26 facilitates the directing of any spillage occurring at the user's forehead 14 away from the user's face 12.

Referring now to FIGS. 1 and 4, face shield/fan 10 is depicted as being generally vertically aligned with respect to the user's face 12. It is contemplated, however, that the face shield/fan 10 may be aligned at an angle with respect to the user's face 12 by moving the handle 24 forward while maintaining the sealing member 22 in contact with user's forehead 14. Such an alignment may facilitate, for example, facial ventilation and/or verbal communication, while substantially maintaining protection the user's face 12.

In the preferred embodiment of the present invention, the upper portion 18 of the mask 16 is provided with an upper edge 30 and the sealing member 22 is provided with a groove 32 which is formed to receive the upper edge 30, for attaching the sealing member 22 to the mask 16. The groove is best seen in the cross-sectional view of the sealing member 22 in FIG. 4.

The sealing member 22 may comprise a generally flexible polymer material. Preferably, the sealing member 22 comprises a rubber material. It is contemplated that the sealing member 22 have the characteristic of being water-resistant which would result in a design which avoids that sealing member 22 from becoming saturated with fluids. The mask 16 may comprise a semi-rigid polymer material. Preferably, the mask 16 comprises a thermoplastic material.

In addition, the mask 16 is formed of a transparent material for allowing the user to see therethrough. It is contemplated that only the portions of the mask 16 which correspond to the user's eyes may be transparent and may comprise a different material type than the rest of the mask 16. For example, the eye portions of the mask 16 may comprise a set of optical lenses integral to the mask 16. Furthermore, the mask 16 may contain indicia thereon and/or therein. For example, referring to FIG. 1, indicia 34 resembles a rose. It is contemplated that the mask 16 may be formed from a sheet of material which may be vacuumed formed and subsequently die-cut. The sheet of material may contain distorted indicia such that the indicia upon being vacuumed formed is stretched into proper proportion. Further, the material itself comprising the mask 16 may be colored and tinted and may contain metallic flakes. It is contemplated that the material may be laminar with various layers containing indicia and/or coloring. The mask 16 may be formed to generally resemble a particular set of ethnic facial features. Although not shown, it is contemplated that such sets of ethnic facial features may for example correspond to Caucasian, Asian, African facial features. Thus, the mask 16 is contemplated to be formed to include contours corresponding to the general shape of a user's eyes, nose, mouth and lips, chin, etc.

Preferably, the mask 16 and the handle 24 are formed of a continuous material. This is especially advantageous from a manufacturing view point where the mask 16 and handle 24 are vacuum formed from a single sheet of thermoplastic material. It is contemplated, however, that the mask 16 and the handle 24 may be separate members.

Preferably, the sealing member 22 is formed of a generally water-resistant material such as rubber. Such a water-resistant material would not only facilitate sealing, but would be comfortable to the user as it would be in direct contact with the user's forehead 14. Being water-resistant, it is contemplated that the sealing member 22 would not become saturated with fluids which may be encountered.

The mask 16 is preferably provided with a pair of opposed side edges 36 and the face shield/fan 10 is further provided with a pair of edge guards 38, as best seen in FIGS. 1, 2 and 5. The edge guards 38 are formed to respectively receive the side edges 36 and are formed of a generally flexible material, for protecting the user's face 12 from the side edges 36 of the mask 16. It is contemplated that the edge guards 38 may extend downward onto the handle 24. In addition, it is contemplated that the edge guards 38, although shown as two separate members in FIGS. 1, 2, and 5, may comprise a single continuous member which extends from one side of the side edges 36 down to the handle 24 and up to the other one of the side edges 36.

In addition, there is provided a method of forming the above described face shield/fan 10 of the present invention. It is contemplated that the various component part of the face shield/fan 10 of the present invention may comprise a thermal plastic material which is vacuum formed and die-cut.

Additional modification and improvements of the present invention may also be apparent to those of ordinary skill in the art. Thus, the particular combination of parts described and illustrated herein is intended to represent only one embodiment of the present invention, and is not intended to serve as limitation of alternative devices within the spirit and scope of the invention.

What is claimed is:

1. A face shield/fan for protecting a user's face against spray and against spillage occurring at the user's forehead, for dissipating odors and heat and for facilitating drying, the face shield/fan comprising:

a mask, generally formed to receive a user's face, comprising an upper portion and a lower portion, the upper portion generally formed to correspond to the user's forehead;

a sealing member, attachable to the upper portion of the mask, generally formed to conform to the contours of the user's forehead for sealing therewith, for directing spillage occurring at the user's forehead away from the user's face; and a handle, disposable adjacent the lower portion of the mask, for manually supporting the face shield/fan against the user's forehead and for facilitating waving of the face shield/fan to dissipate odors and heat and facilitate drying.

2. The face shield/fan of claim 1 wherein the sealing member comprising a channel, generally formed to span the width of the user's forehead and formed to face outward from the user's face, for directing spillage away from the user's face.

3. The face shield/fan of claim 2 wherein the channel further formed to extend generally downward adjacent to the user's eyes, for directing spillage away from the user's face and eyes.

4. The face shield/fan of claim 2 wherein the channel further formed to extend generally downward below the user's eyes, for directing spillage away from the user's face and eyes.

5. The face shield/fan of claim 1 wherein the upper portion of the mask having an upper edge and the sealing member comprising a groove formed to receive the upper edge, for attaching the sealing member to the mask.

6. The face shield/fan of claim 1 wherein the sealing member comprising a generally flexible polymer material.

7. The face shield/fan of claim 1 wherein the sealing member comprising a rubber material.

8. The face shield/fan of claim 1 wherein the mask comprising a semi-rigid polymer material.

9. The face shield/fan of claim 1 wherein the mask comprising a thermoplastic material.

10. The face shield/fan of claim 1 wherein the mask comprising a transparent material for allowing the user to see therethrough.

11. The face shield/fan of claim 1 wherein the mask containing indicia thereon.

12. The face shield/fan of claim 1 wherein the mask containing visible indicia therein.

13. The face shield/fan of claim 1 wherein the mask being formed to generally resemble a particular set of ethnic facial features.

14. The face shield/fan of claim 1 wherein the mask and the handle being formed of a continuous material.

15. The face shield/fan of claim 1 where in the mask further comprising a pair of opposed side edges and the face shield/fan further comprising a pair of edge guards formed to respectively receive the side edges, formed of a generally flexible material, for protecting the user's face from the side edges of the mask.

16. A face shield/fan for protecting a user's face against spray and against spillage occurring at the user's forehead, for dissipating odors and heat and for facilitating drying, the face shield/fan comprising:

a mask, generally formed to receive a user's face, comprising an upper portion and a lower portion, the upper portion generally formed to correspond to the user's forehead;

a sealing member, attachable to the upper portion of the mask, comprising:

a sealing portion generally formed to conform to the contours of the user's forehead for sealing therewith; and a channel, generally formed to span the width of the user's forehead and formed to face outward from the user's face, for directing spillage away from the user's face; and a handle, disposable adjacent the lower portion of the mask, for manually supporting the face shield/fan against the user's forehead and for facilitating waving of the face shield/fan to dissipate odors and heat and facilitate drying.

17. The face shield/fan of claim 16 wherein the channel further formed to extend generally downward to a position which is below the user's eyes, for directing spillage away from the user's face and eyes.

18. The face shield/fan of claim 16 wherein the channel further formed to extend generally downward below the user's eyes, for directing spillage away from the user's face and eyes.

19. A method of forming a face shield/fan for protecting a user's face against spray and against spillage occurring at the user's forehead, for dissipating odors and heat and for facilitating drying, the method comprising the steps of:

(a) forming a mask to receive a user's face, the mask comprising an upper portion and a lower portion, the upper portion generally formed to correspond to the user's forehead;

(b) forming a sealing member to generally conform to the contours of the user's forehead for sealing therewith and attachable to the upper portion of the mask, for directing spillage occurring at the user's forehead away from the user's face; and (c) forming a handle, disposable adjacent the lower portion of the mask, for manually supporting the face shield/fan against the user's forehead and for facilitating waving of the face shield/fan to dissipate odors and heat and facilitate drying.

20. The method of claim 19 wherein step (b) the sealing member comprising a channel, generally formed to span the width of the user's forehead and formed to face outward from the user's face, for directing spillage away from the user's face.

* * * * *